US006488020B1

(12) United States Patent
Rosas-Magallan

(10) Patent No.: US 6,488,020 B1
(45) Date of Patent: Dec. 3, 2002

(54) SOCCER BALL SERVING MACHINE

(76) Inventor: Israel Rosas-Magallan, 523 Encino Dr., Aptos, CA (US) 95003

( * ) Notice: Subject to any disclaimer, the term of this patent is extended or adjusted under 35 U.S.C. 154(b) by 0 days.

(21) Appl. No.: 09/859,350

(22) Filed: May 16, 2001

(51) Int. Cl.[7] ..... F41B 4/00
(52) U.S. Cl. ..... 124/78
(58) Field of Search ..... 124/6, 78

(56) References Cited

U.S. PATENT DOCUMENTS

| | | | | |
|---|---|---|---|---|
| 2,716,973 A | | 9/1955 | Desi | |
| 3,724,437 A | | 4/1973 | Halstead | |
| 4,323,048 A | | 4/1982 | Saito et al. | |
| 4,442,823 A | * | 4/1984 | Floyd et al. | 124/78 |
| 4,678,189 A | | 7/1987 | Koss | |
| 4,834,060 A | | 5/1989 | Greene | |
| 5,125,653 A | * | 6/1992 | Kovacs et al. | 124/78 X |
| 5,865,161 A | | 2/1999 | Bruce | |
| 5,964,209 A | | 10/1999 | Boehner | |

* cited by examiner

*Primary Examiner*—John A. Ricci
(74) *Attorney, Agent, or Firm*—LaRiviere, Grubman & Payne, LLP

(57) ABSTRACT

A training machine which projects a ball such as a soccer ball for presentation to the player. The machine propels balls with a maximum degree of freedom in selecting ball trajectories at unlimited angles, distances and velocities by mounting the propelling wheels on a plate rotatable approximately 120 degrees. The machine has an adjustable foot for adjusting the tilt of the rotatable plate. The machine is light weight and easily assembled and disassembled for transportation and storage. An electrical control regulates the speed of each projection wheel, providing an infinite variety of spin control to the projected ball.

18 Claims, 4 Drawing Sheets

SOCCER BALL SERVING MACHINE

TECHNICAL FIELD OF THE INVENTION

The present invention relates generally to sports training apparatuses, more particularly to ball throwing or pitching machines, and more specifically to soccer ball throwing machines for use in training and practice situations.

BACKGROUND ART

Sports played with thrown, batted or kicked balls have become widely popular, for both amateur and professional players. In every sport, it is necessary to practice regularly to attain any proficiency. It is also necessary to become more efficient in practice so that the time available for each player to participate is maximized. To improve practice efficiency, numerous machines have been created to simulate the repetitive action of propelling the ball to the player so that appropriate actions such as batting, catching or hitting the ball can be performed.

An early ball throwing machine, U.S. Pat. No. 2,716,973 to Desi, was directed to baseball batting practice. This machine simulated the actions of a pitcher, delivering balls to a batter at regular intervals. Desi does not, however, suggest or teach ways that the machine could be adapted to larger balls, changing player positions, or widely variable pitch angles. U.S. Pat. No 3,724,437 to Halstead, also directed to baseball practice, improves the range of pitches simulated for batting practice. Halstead also, does not suggest ways to adapt his invention to the larger size and differing requirements of soccer. Similarly, U.S. Pat. No. 5,865,161 to Bruce, improved upon the baseball practice machines by improving the accuracy of the pitched ball delivery, but again does not suggest ways to adapt for other sports. These machines are suitable only for baseball practice since the relative positions of a pitcher and batter are generally fixed during practice, and the machines are not readily adaptable for widely varying ball delivery patterns for a player's practice.

Volleyball practice machines, represented by U.S. Pat. No 4,323,048 to Saito et al., simulate the special ball delivery methods for this sport: serve, toss and spike for example. Saito teaches an adjustable machine, capable of delivering the variety of ball motions for this sport, but does not teach how the adjustments can be made so that a variety of deliveries can be randomly selected to challenge the player. Similarly, U.S. Pat. No 5,964,209 to Boehner is an aid for volleyball practice but not readily adaptable to other sports such as soccer.

A machine capable of determining a player's position on a basketball court, and returning a ball to that position, is described in U.S. Pat. No 4,678,189 to Koss. This machine delivers the ball to much of the court area, varying the loft of the toss to reach further if necessary. This does not, however, suggest how a controlled variety of deliveries to a soccer player may be made. Tennis machines such as U.S. Pat. No 4,834,060 to Greene aid in the practice of that sport by providing regularly projected tennis balls to a player for practice. Here too, the range of delivery options is not suitable to field sports such as soccer.

What is needed is a machine capable of propelling balls such as for soccer in a variety of presentations suitable for goalies who may catch the ball with their hands or other players who must kick the ball or strike it with their head, not touching the ball with their hands. The machine should be easily transportable to the practice field and capable of quickly changing from one type of delivery to another, simulating playing situations for all team members.

BRIEF DISCLOSURE OF THE INVENTION

The present invention is a training machine which projects a ball such as a soccer ball with a wide variety of presentations to the player. The machine propels soccer balls with a maximum degree of freedom in selecting ball trajectories by mounting the propelling wheels on a plate which is free to rotate through approximately 120 degrees. The machine functions as an automatic coaching partner for duplicating any type of game situation during training. This durable apparatus reproduces game-like shots at the goal as well as passes at unlimited angles, distances and velocities. The machine is user friendly, using simple controls for speed and trajectory for each consecutive serve. The machine is light weight in the preferred embodiment and may be easily assembled and disassembled for transportation and storage. The simplicity of operation makes the machine suitable for use by children as well as by professional players.

The simple electrical controls which regulate the speed of each projection wheel provide an infinite variety of spin control to the projected ball to effect difficult ball deliveries. A simple manual tilt control allows the machine to be varied in tilt angle to give a duality to the directional control not found in any other ball delivery machine. All of the controls are easily adjusted by the operator, providing a unique method for the delivery of practice balls to players at any position on the field.

BRIEF DESCRIPTION OF THE SEVERAL VIEWS OF THE DRAWING

For fuller understanding of the present invention, reference is made to the accompanying drawing in the following DETAILED DESCRIPTION OF THE INVENTION. In the drawing.

Figure 1:
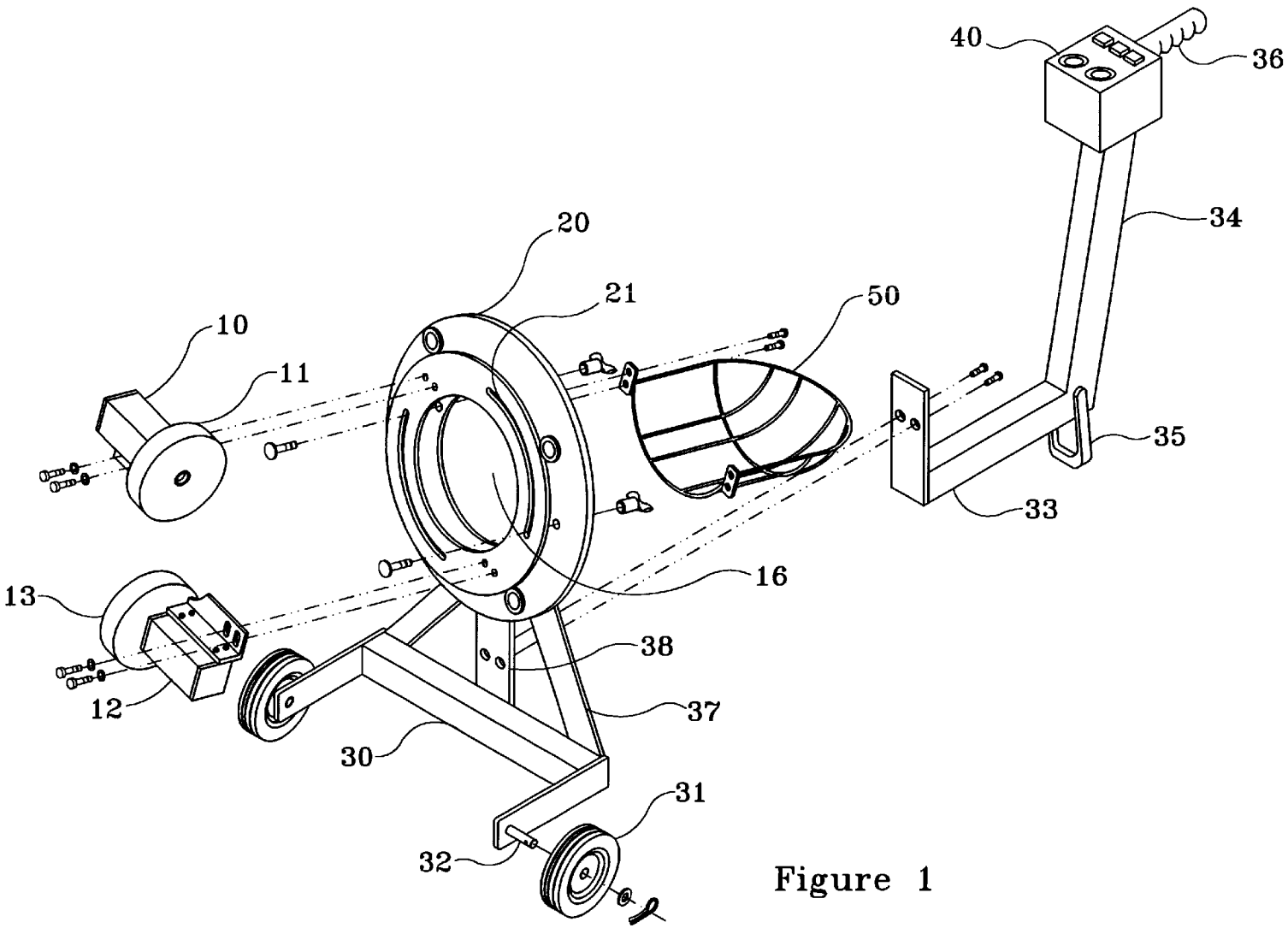
FIG. 1 is an exploded perspective view of a machine constructed according to the present invention.

Reference numbers refer to the same or equivalent parts of the present invention throughout the several figures of the drawing.

DETAILED DESCRIPTION OF THE INVENTION

The present invention is a training machine which projects a ball such as a soccer ball with a wide variety of presentations to the player. While the machine may be constructed to accommodate any size ball such as a ping pong ball, field hockey ball, lacrosse ball, volley ball, or a kick ball, the exemplary configuration is for a soccer ball. Soccer balls are conventionally available in three sizes: 3, 4, and 5, the smallest being used by younger players and the largest by the older players, including professional players. The machine of the exemplary description below propels any size of soccer ball with a maximum degree of freedom in selecting ball trajectories. The apparatus reproduces game-like shots at the goal as well as passes at unlimited angles, distances and velocities. The machine is user friendly, using simple controls for speed and trajectory for each consecutive serve. The machine is light weight and easily assembled and disassembled for transportation and storage.

One of the new and original features of the machine is that it provides a simple means to swivel the wheeled ball delivery assembly to provide angular projection of the ball. The simple electrical control which regulates the speed of each projection wheel provides for an infinite variety of spin control to the projected ball to effect difficult ball deliveries. A simple additional manual tilt control gives the machine additional ball projection elevation angle variety, giving a duality to the directional control not found in any other ball delivery machine. All of the controls are easily adjusted by the operator, providing a unique method for the delivery of practice balls to players at any position on the field.

Referring to FIG. 1, an exploded view of a machine constructed according to the present invention is shown. It is to be understood that other construction techniques may be used and structural design changes may be made which will be within the scope and teaching of the present invention. In the figure, first drive motor 10 spins first wheel 11 in response to the settings of control 40, discussed below. Opposing first wheel 11 is second drive motor 12, which similarly drives second wheel 13 in a manner counter-rotating to wheel 11 under the control of control 40. Motors 10, 12 are of any variety of adjustable speed motor, powered by either alternating or direct current. Wheels 11, 13 are typically nonmarking pneumatic tires but may be of any material that will provide grip to hold the ball to be projected.

Wheels 11, 13 are arranged to be spaced apart so that the circumference of each is separated and are rotatable in the same plane. The nip or separation 15, shown in FIG. 2, between the circumference of each wheel is chosen to be slightly less than the diameter of the ball to be projected, such as a soccer ball. The separation 15 between wheels 11, 13 may be adjustable in a manner known in the art by making the mounting of motors 10, 12 adjustable. For example, the mount could use bolts or studs with either lock washers and nuts or locking nuts. If desired, wing nuts or handled nuts could be used, and mounting holes in the plate, or mounting slots could be used to allow for adjustment of the separation 15 between wheels 11, 13. Alternatively, the exemplary embodiment of the invention may be adjusted for a size 5 soccer ball and used without adjustment for ball sizes 3 or 4. In this event, the contact between wheels 11, 13 and the ball is lessened, resulting in some loss of selection in the ball's rate of spin but not affecting the directional presentation of the ball to the player. It is further understood that simple design variations in the brackets supporting motors 10, 12 can be made to provide for use of the machine with balls with diameters different from soccer balls.

Motors 10, 12, are mounted to swivel plate 24 in an adjustable or fixed manner. Plate 20 is mounted on frame 30 by fixedly attaching it to braces 37 and upright 38. Slots 21 in plate 24 allow plate 24 to be rotated about its centerline for approximately 120 degrees of rotation, providing the user with the ability to direct the projected ball in a nearly infinite choice of directions. This unique feature of the machine provides a simple means to swivel the wheel delivery assembly to provide angular projection of the ball. In use, the user rotates plate 24 at will to project the ball in any direction, from low and straight to high and curved trajectories. It is further understood that construction of swivel plate 24 to allow for rotation greater than approximately 120 degrees, up to 360 degrees, is possible within the scope of the present invention.

Frame 30 may be constructed of any light weight material, preferably aluminum, but other materials such as wood, fiber reinforced polymers, or other metals including steel could be used. The choice of materials is dictated by the need for strength with relatively light weight for ease in moving the device on and off the field. In the preferred embodiment, most joints and connections are designed to be easily disassembled and reassembled, such as by wing nuts or other speed-locking nuts for example. Fixed joints may be used as desired. Wheels 31 rotate on axles 32 to provide mobility on or to the practice site. Extension 33, arm 34, and handle 36 attach to upright 38 as shown to provide a convenient means for maneuvering the machine. Kick stand 35 is rotatably attached to arm 34 to provide an easy adjustment of the tilt of plate 20 by rotating kick stand 35 between positions parallel and vertical to extension 33. Kick stand 35 is shown as a leg, but could alternatively be a circular or elliptical plate asymmetrically mounted to arm 34, or a ratcheting arrangement to provide a variety of elevation angle selections. This secondary adjustment capability provides, in combination with the rotational adjustment capability of plate 24, a duality of ball projection elevation angle adjustments not found in other ball-propelling machines.

Control 40 consists of electrical switches and other devices to control the speed at which motors 10, 12 rotate wheels 11, 13. Each motor 10, 12, is separately adjusted so that counter rotating wheels 11, 13 will impart any desired spin to the projected ball. Control 40 may be designed for either alternating or direct current sources. In the preferred embodiment, an alternating current source is used. If desired, a battery source of power may be provided to operate the machine. Details of control 40 are well known and are therefore omitted in the interest of brevity. It is further understood that control 40 may be constructed to provide either or both local (at the machine) or remote (away from the machine) controls for the convenience of the user in adjusting ball spin and projection angle. Remote controls may be either wire type or wireless.

Basket 50 is sized to receive a soccer ball and direct it into the nip between wheels 11, 13. Basket 50 may conveniently hold one or more balls, which are directed into the nip by the user who has control also of the rotational position of plate 20. In the preferred portable embodiment shown, basket 50 would conveniently hold up to three balls. In a larger embodiment, basket 50 could be scaled up to hold more than three balls as desired or dictated by the intended use. Further, basket 50 remains in the same position throughout the machine's operation thereby enhancing stability and the accuracy of the throw. Additionally, basket 50 may be provided with a remotely controllable feed mechanism to allow a user to sequentially feed balls to the machine for projection.

Figure 2:
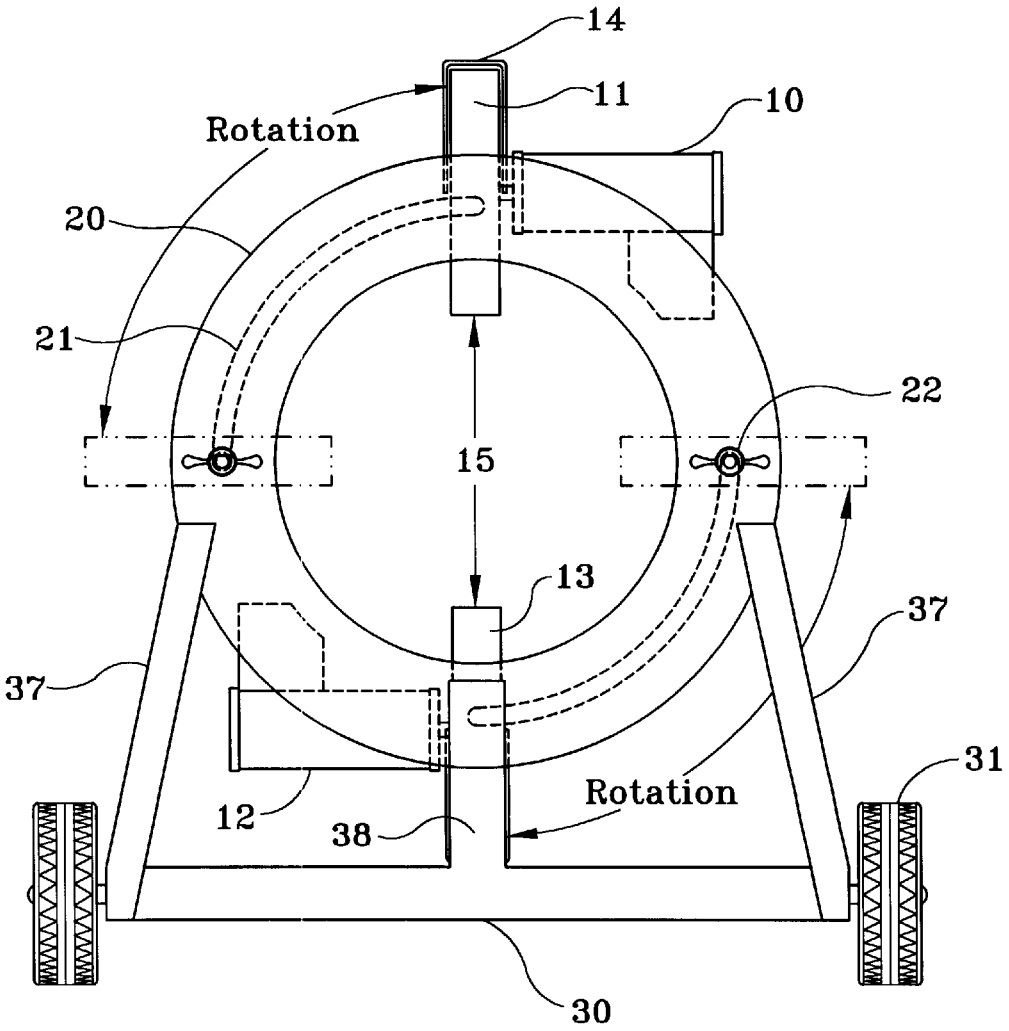
FIG. 2 is a rear view of the machine of FIG. 1.

Referring now to FIG. 2, a rear view of the machine is shown. Plate 20 is circular with a large opening 16 in the center through which the ball to be propelled passes. Nip or separation 15 between wheels 11, 13 is shown when the swivel plate 24 has been rotated so that wheels 11, 13 are in a vertical orientation. Wheel guards 14 are shown in position covering wheels 11, 13 to provide entanglement protection. Locking nuts 22 are normally loosened to allow for free rotation of plate 24, but may be tightened if desired to allow for repetitive ball delivery, or for stability when the machine is transported or stored.

Figure 3:
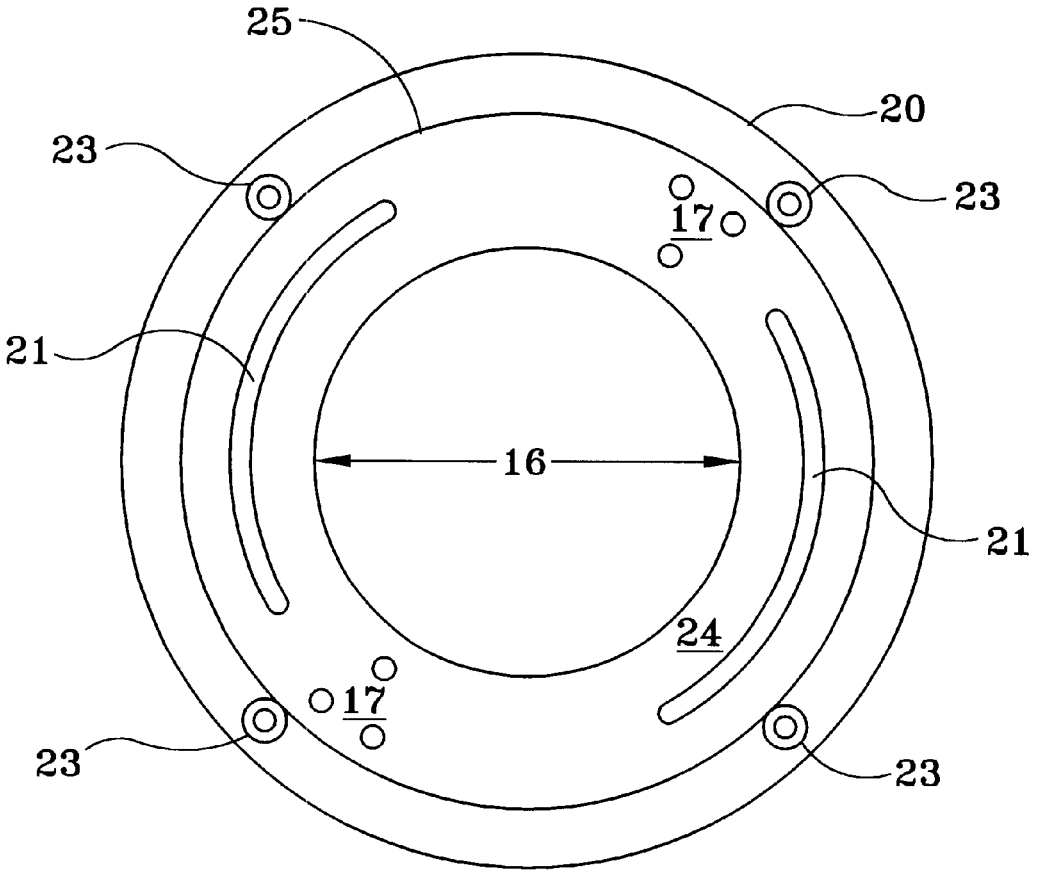
FIG. 3 is a frontal view of the swivel plate assembly of the machine of FIG. 1.
Figure 4:
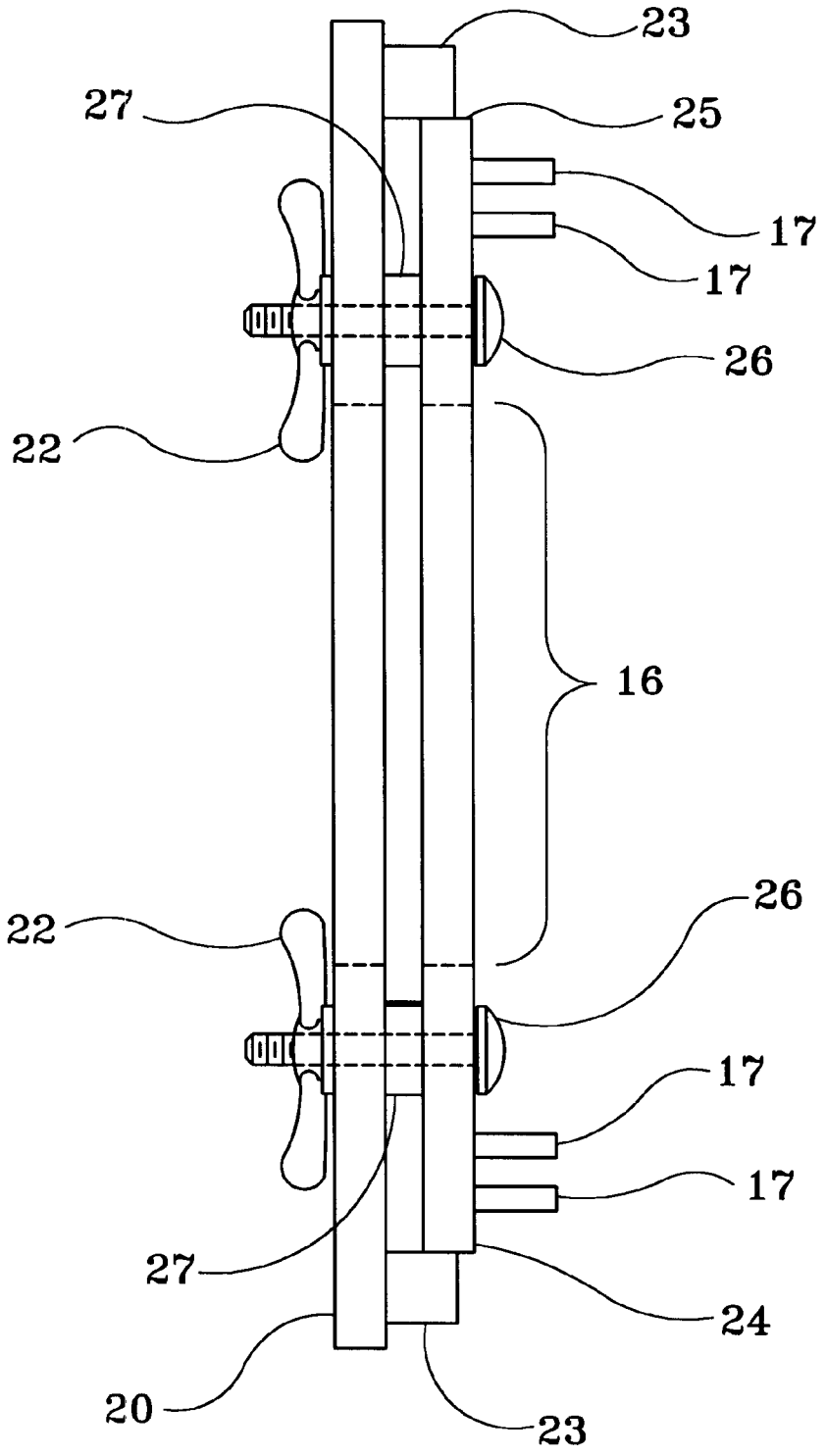
FIG. 4 is an edge view of the swivel plate assembly of the machine of FIG. 1.

FIG. 3 shows more details of swivel plate 24 in plan view and in FIG. 4, in side view. Plate 20 is circular, and in the exemplary embodiment, made of metal plate. An aperture 16 is located in the center of plate 20 and is sized to accommodate the ball to be propelled therethrough. Rotating plate 24 is concentric with plate 20 and has an aperture 16 also. On rotating plate 24 are two arrays of studs 17 for mounting motors 10, 12 (not shown). Studs 17 may be any number, nominally two to four, and three are indicated in the figures as an example. Plate 24 is held in concentric alignment with plate 20 by rotatable bearings 23 which are secured to plate 20 and located to provide frictional contact with circumference 25 of plate 24. In the exemplary embodiment, four bearings 23 are shown; a minimum of three is required to properly align plate 24 with plate 20. Additional bearings 23 may be used, up to and including a continuous rim about plate 20 to hold within it plate 24. As plate 24 is rotated, bearings 23 provide for easy rotation thereof by the operator.

Slots 21 within plate 24 extend for approximately 120 degrees concentrically around plate 24. A minimum of 90 degrees of rotation is desired for selection of the direction of ball projection; approximately 120 degrees appears to be a practical limit when space is reserved for motor mounting studs 17. If 360 degree rotation is desired, studs 17 may be relocated and the mounts for motors 10, 12 would have to be designed appropriately. Additionally, some form of bridge would be required over slots 21 or additional bearings 23 placed on an inner circumference of plate 24, for example. Bolts 26 extend through slots 21, slip washer 27, and an aperture in plate 20. Wing nuts 22 are loosened to allow plate 24 to rotate freely in use, and are tightened to secure the apparatus for transportation or storage. A handle, not shown, may be fastened at any convenient point on plate 24 for the operator to grasp for adjusting the angular position of plate 24.

While the above preferred embodiment describes a light weight soccer training device which may be easily disassembled for transport or storage and reassembled at the location for its use, the invention should be understood to be adaptable for use in training for other sports where a variety of ball presentations to the trainee is desired. Other embodiments suitable for other balls may be constructed in a like manner. Both fixed and transportable devices, as well as devices not designed for disassembly, for use in training in ping pong, field hockey, lacrosse, kick ball, volley ball, baseball, slow pitch softball or conventional softball are also contemplated to be within the scope of the present invention.

Information as herein shown and described in detail is fully capable of attaining the above-described object of the invention, the presently preferred embodiment of the invention, and is, thus, representative of the subject matter which is broadly contemplated by the present invention. The scope of the present invention fully encompasses other embodiments which may become obvious to those skilled in the art, and is to be limited, accordingly, by nothing other than the appended claims, wherein reference to an element in the singular is not intended to mean "one and only one" unless explicitly so stated, but rather "one or more". All structural and functional equivalents to the elements of the above-described preferred embodiment and additional embodiments that are known to those of ordinary skill in the art are hereby expressly incorporated by reference and are intended to be encompassed by the present claims.

Moreover, no requirement exists for a device or method to address each and every problem sought to be resolved by the present invention, for such to be encompassed by the present claims. Furthermore, no element, component, or method step in the present disclosure is intended to be dedicated to the public regardless of whether the element, component, or method step is explicitly recited in the claims. However, it should be readily apparent to those of ordinary skill in the art that various changes and modifications in form, material, and fabrication detail may be made without departing from the spirit and scope of the inventions as set forth in the appended claims. No claim herein is to be construed under the provisions of 35 U.S.C. 112, sixth paragraph, unless the element is expressly recited using the phrase "means for".

What is claimed is:

1. A ball propelling apparatus comprising:

a ball holding means attached to a frame;

a first motor for rotating a first wheel;

a second motor for rotating a second wheel in a direction opposite from the first wheel;

a plate having the first and second motors mounted thereon in a manner so that the first and second wheels are diametrically opposed, the plate having an opening therein, the plate being rotatably attached to the frame;

an adjustable leg attached to the frame for altering the tilt of the plate; and a controller for individually adjusting the speed of rotation of each of the first and second motors.

2. The apparatus of claim 1 wherein the first and second wheels counter rotate in the same plane.

3. The apparatus of claim 2 wherein the circumference of the first and second wheels are separated by a distance.

4. The apparatus of claim 3 wherein the distance is approximately equal to the diameter of a ball.

5. The apparatus of claim 4 wherein the ball is selected from a group consisting essentially of a soccer ball, kick ball, volley ball, base ball, slow-pitch softball, conventional softball, field hockey ball, ping pong ball, and lacrosse ball.

6. The apparatus of claim 1 wherein the plate can rotate about its axis for at least approximately 90 degrees to approximately 120 degrees.

7. The apparatus of claim 1 wherein the first and second motors are adjustably mounted to the plate.

8. The apparatus of claim 1 further having at least two wheels and one handle attached to the frame to provide mobility to the apparatus.

9. A ball propelling apparatus comprising:

a ball holding means attached to a frame;

a first motor for rotating a first wheel;

a second motor for rotating a second wheel in a direction opposite from the first wheel and in the same plane as the first wheel;

a plate having the first and second motors mounted thereon in a manner so that the first and second wheels are diametrically opposed, the plate having an opening therein, the plate being rotatably attached to the frame;

an adjustable leg attached to the frame for altering the tilt of the plate; and a controller for individually adjusting the speed of rotation of each of the first and second motors.

10. The apparatus of claim 9 wherein the circumference of the first and second wheels are separated by a distance approximately equal to the diameter of a ball.

11. The apparatus of claim 10 wherein the ball is selected from a group consisting essentially of soccer ball, kick ball, volley ball, base ball, slow-pitch soft ball, conventional soft ball, ping pong, field hockey ball, and lacrosse ball.

12. The apparatus of claim 9 wherein the plate can rotate about its axis for approximately at least 90 degrees to approximately 120 degrees.

13. The apparatus of claim 8 wherein the first and second motors are adjustably mounted to the plate.

14. The apparatus of claim 8 further having at least two wheels and a handle attached to the frame to provide mobility.

15. A ball propelling apparatus comprising:

a ball holding means attached to a frame;

a first motor for rotating a first wheel;

a second motor for rotating a second wheel in a direction opposite from the first wheel and in the same plane as the first wheel;

a plate having the first and second motors mounted thereon in a manner so that the first and second wheels are diametrically opposed and separated by a distance, the plate having an opening therein, the plate being attached to the frame and rotatable for at least 90 degrees to approximately 120 degrees;

an adjustable leg attached to the frame for altering the tilt of the plate; and a controller for individually adjusting the speed of rotation of each of the first and second motors.

16. The apparatus of claim 15 wherein the distance is approximately equal to the diameter of a ball selected from a group consisting essentially of soccer ball, kick ball, volley ball, field hockey ball, base ball, slow-pitch softball, conventional soft ball, ping pong ball, and lacrosse ball.

17. The apparatus of claim 15 wherein the first and second motors are adjustably mounted to the plate.

18. The apparatus of claim 15 further having at least two wheels and a handle attached to the frame to provide mobility.

* * * * *